US005535792A

United States Patent [19]

McGregor

[11] Patent Number: 5,535,792

[45] Date of Patent: Jul. 16, 1996

[54] HIGH SPEED BAG FILLING MACHINE

[76] Inventor: James R. McGregor, 23175 France Cir., Lakeville, Minn. 55044

[21] Appl. No.: 347,801

[22] Filed: Dec. 1, 1994

[51] Int. Cl.[6] ..... B65B 1/00; B65B 7/06

[52] U.S. Cl. ..... 141/129; 141/166; 141/316; 53/527; 53/573; 53/578

[58] Field of Search ..... 141/10, 129, 166, 141/313–317, 369–371, 377, 378; 53/578, 573, 571, 175, 570, 526, 527

[56] References Cited

U.S. PATENT DOCUMENTS

| | | | |
|---|---|---|---|
| 4,078,358 | 3/1978 | Henderson | 53/573 |
| 4,169,345 | 10/1979 | Douwenga | 53/570 |
| 4,322,932 | 4/1982 | McGregor | 53/505 |
| 4,432,186 | 2/1984 | McGregor | 53/69 |
| 4,526,214 | 7/1985 | McGregor | 141/59 |
| 4,612,965 | 9/1986 | McGregor | 141/114 |
| 5,327,947 | 7/1994 | McGregor | 141/71 |

*Primary Examiner*—Henry J. Recla
*Assistant Examiner*—Steven O. Douglas
*Attorney, Agent, or Firm*—Moore & Hansen

[57] ABSTRACT

A high speed bag filling machine utilizing a tiltable spout for attaching a bag in a tilted position and reversing the tilting motor to move the spout and bag over a conveyor. A vertically movable transfer carriage comprises a front forming bar and a pair of horizontally rotatable rotor arms. The bar and rotors clamp the filled bag, lower it to a conveyor, and discharge it. The forming bar then swings forward and upward to clear the rotor arms, which rotate forwardly beneath it to permit the next bag to enter the clamping area. The forming bar then swings down to engage the front face of the bag and the rotor arms continue their rotation to engage the rear face of the bag. The forming bar and rotor arms may include endless belts driven to discharge the bag.

10 Claims, 12 Drawing Sheets

HIGH SPEED BAG FILLING MACHINE

BACKGROUND OF THE INVENTION

This invention relates generally to bag handling machines of the type including a hopper from which particulate material is dispensed in predetermined quantities or batches through a spout on which a bag is hung for filling. More particularly, this invention pertains to such apparatus for automated bag filling and transfer.

Machines of this general type are shown in my prior U.S. Pat. No. 4,432,186, U.S. Pat. No. 4,322,932, U.S. Pat. No. 4,612,965, and U.S. Pat. No. 5,327,947, the contents of which are hereby incorporated by reference.

As shown in U.S. Pat. No. 4,322,932, a prior art filling machine utilizes a pair of rail mounted arms for laterally gripping the filled bag and carrying the bag to a bag closing station. Such movement is time consuming, particularly in a system requiring a throughput of 12–15 or more bags per minute. In addition, the space required for the traversing and vertical movements of the rail mounted system may be excessive in some applications.

Although such machines have constituted advancement in the art, the need for filling machines with higher throughput remains. In general, the throughput of filling machines of this type is limited by the filling speed of a given size spout and by the fraction of the total cycle time during which a bag is being filled. It would be useful to effectively limit the time consumed in activities ancillary to filling, for example, by creating a machine in which several normally sequential operations can be performed simultaneously.

BRIEF SUMMARY OF THE INVENTION

It is a primary object of this invention to provide a bag filling machine which achieves uniform and reproducible filling and transfer of paper bags at higher speeds than previously possible.

It is a further object to provide such higher operating speeds for open mount paper bags which are to be closed by sewing or plastic bags to be closed by heat sealing, stitching or adhesive.

It is another object of the invention to provide a bag filling machine in which actions normally done sequentially may be accomplished simultaneously to enhance the speed of operation.

It is a further object of this invention to provide a high speed bag filling machine which takes up a minimum of floor space.

The invention comprises a high speed bag filling machine including a fill spout on a hopper which is tiltable from a bag attachment position to a bag removal position. The bag may be filled in either position of the fill spout, or in the transition from the bag attachment position to the bag removal position. A particular feature of the machine is a vertically movable transfer carriage which includes a bag forming bar and rotor arms which span and grasp an upper portion of a filled bag, lower it to a discharge position and discharge it from the machine to e.g. a sealer. Each rotor arm is rotated unidirectionally beneath the bag forming bar which tilts outwardly and upwardly out of the way.

In one form of the invention, the bag forming bar and rotor arms each include a movable endless belt which forms the primary contact with the bag. The belts are driven to discharge the bag from the bag filling machine while a subsequent bag is being mounted on the fill spout and being filled.

A further feature of the invention comprises a set of secondary bars mounted on the bag forming bar and matching secondary bars mounted on the rotor arms. These secondary bars interact to compress the upper portion of the filled bag for maintaining a firm grip while the bag is being lowered. The grip is activated by one or more dual acting power cylinders acting on a secondary bar mounted on the bag forming bar.

The transfer carriage obviates the need for apparatus which travels with the filled bag to carry it to the sealer. The sealer infeed may be immediately adjacent the filling machine, reducing the floor space required by the filling and sealing operations. Furthermore, both the size and complexity of the bag filling and discharge machine are reduced.

The particular combination of elements and movements thereof results in a machine whose throughput is considerably higher than other bag filling machines of this type. In preliminary tests, throughput rates of up to 22 40-pound bags per minute were obtained.

The aforenamed objects as well as other objects and advantages of the invention will be readily understood by reading the following description in conjunction with the accompanying figures of the drawings wherein like reference numerals have been applied to designate like elements throughout the several views.

DESCRIPTION OF THE ILLUSTRATED EMBODIMENTS

Figure 1:
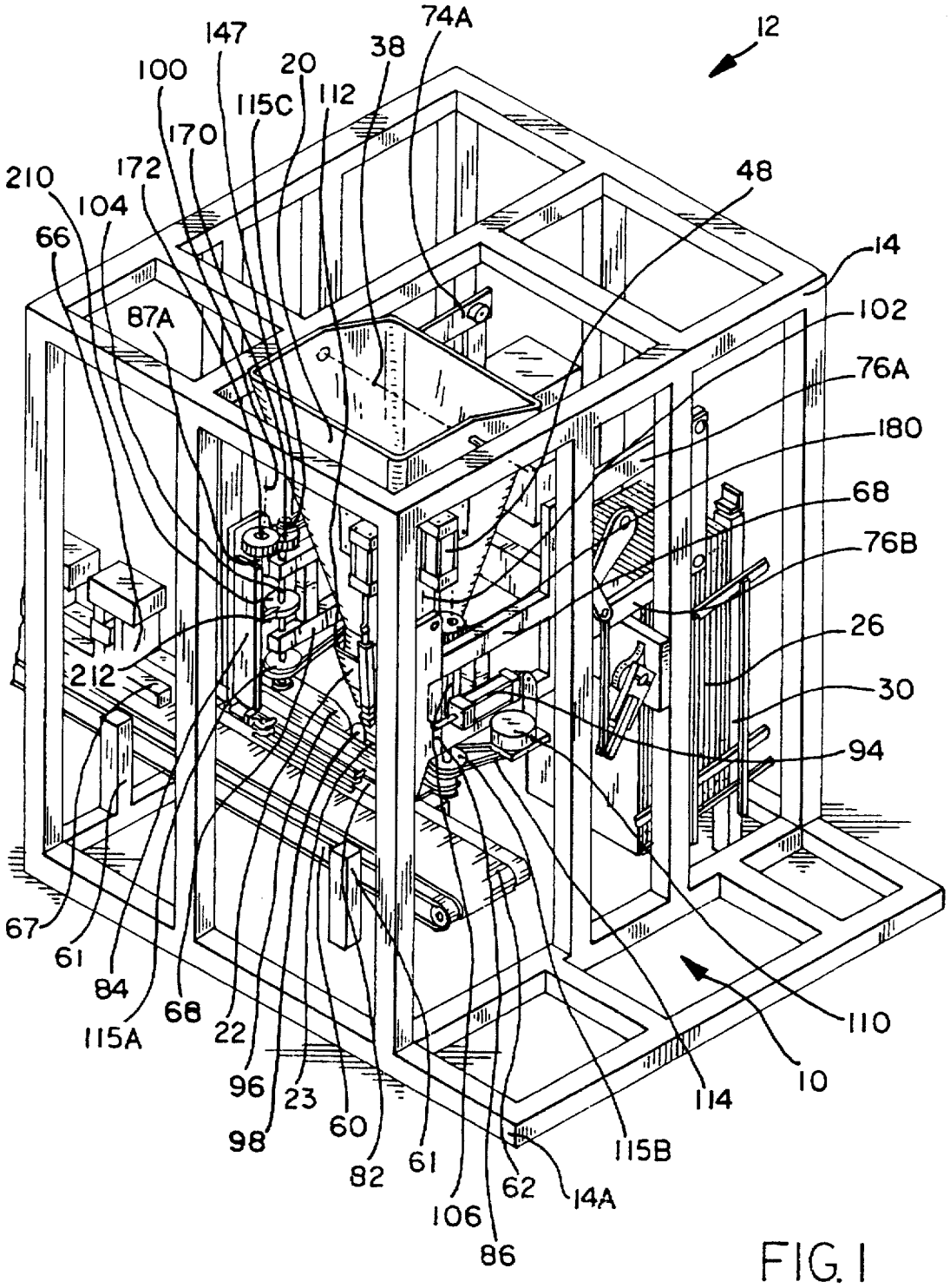
FIG. 1 is a perspective partial view of a high speed bag filling machine of the invention.
Figure 2:
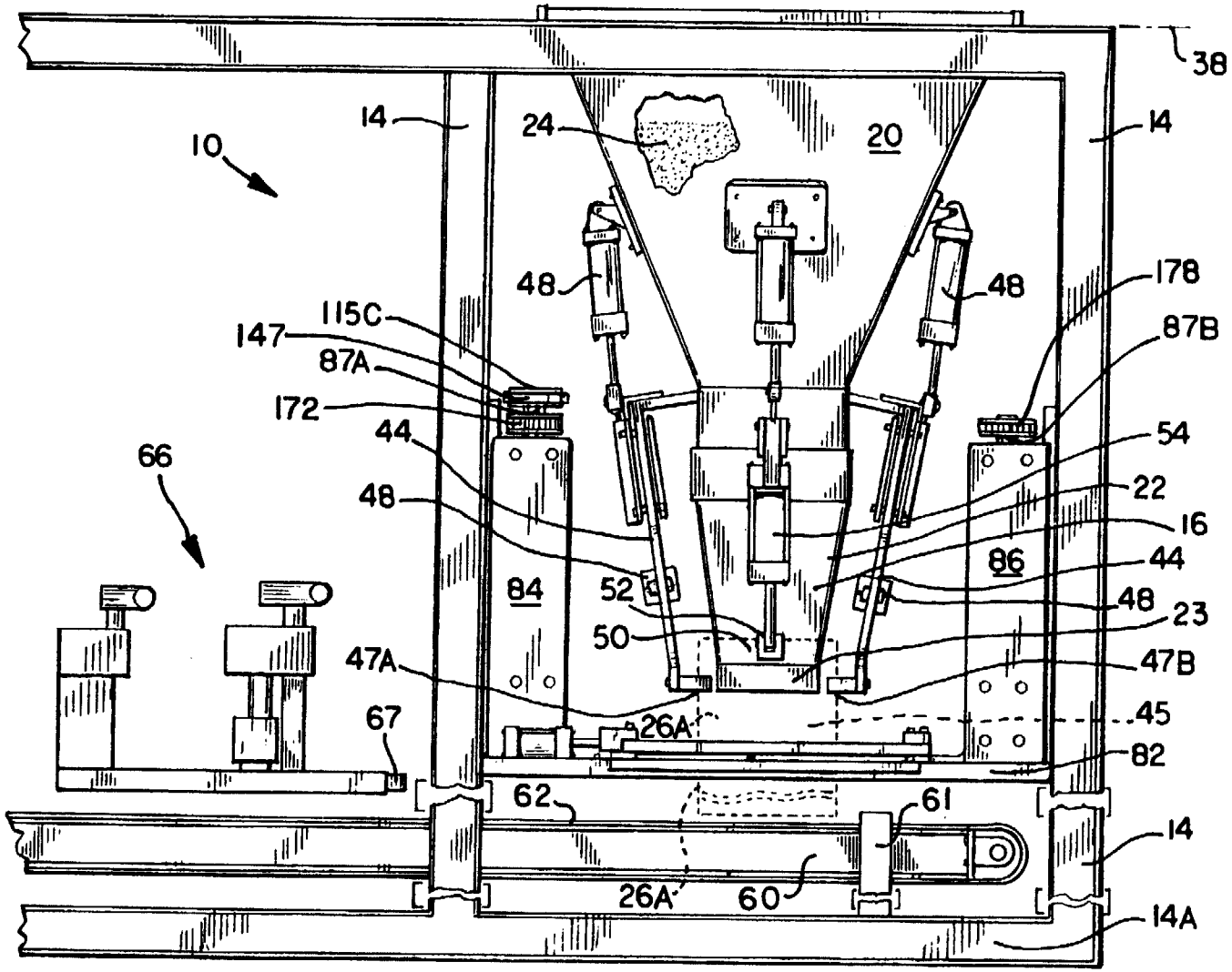
FIG. 2 is a partial front view of a high speed bag filling machine of the invention.
Figure 3:
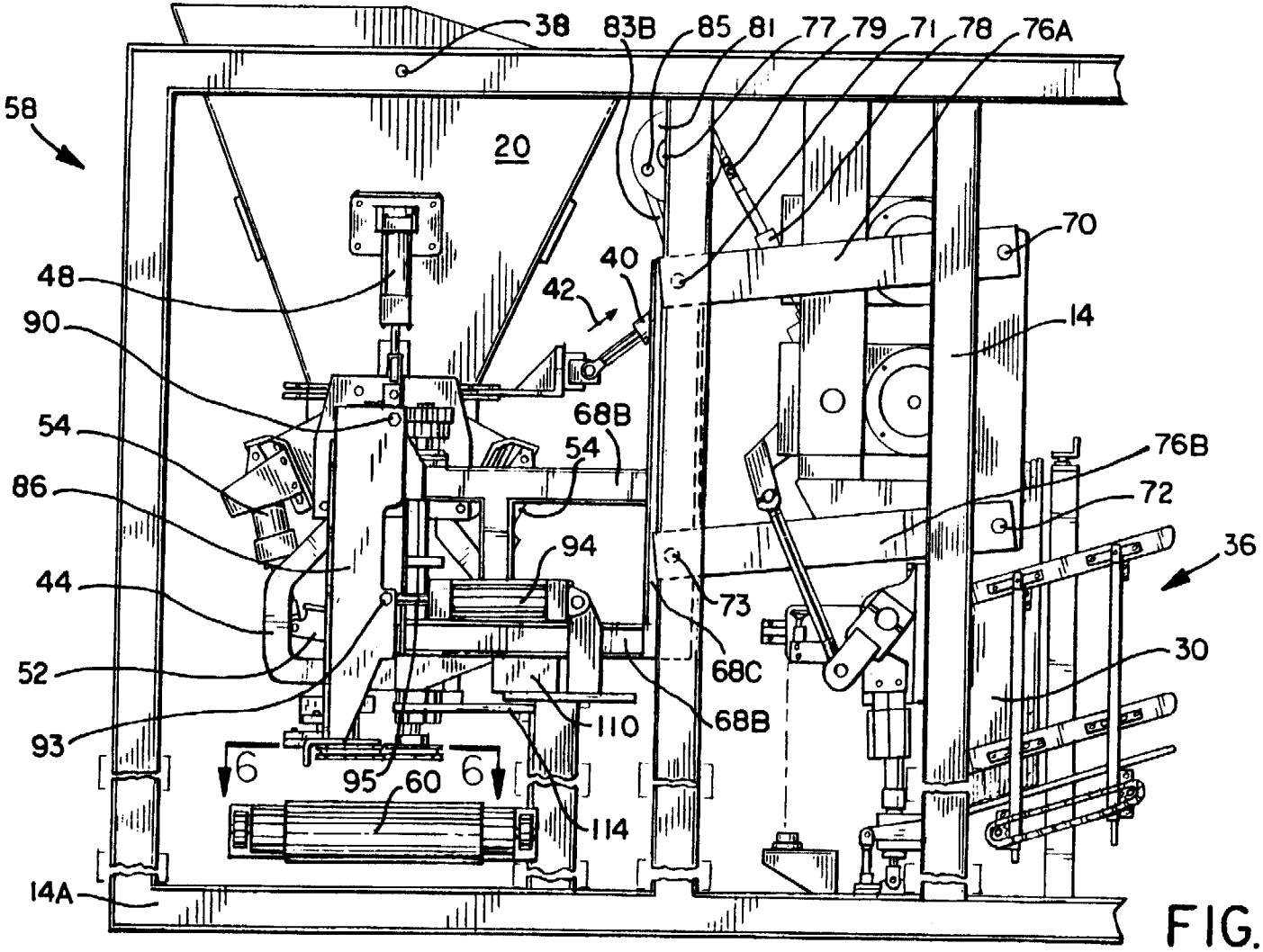
FIG. 3 is a partial right side view of a high speed bag filling machine of the invention.
Figure 8:
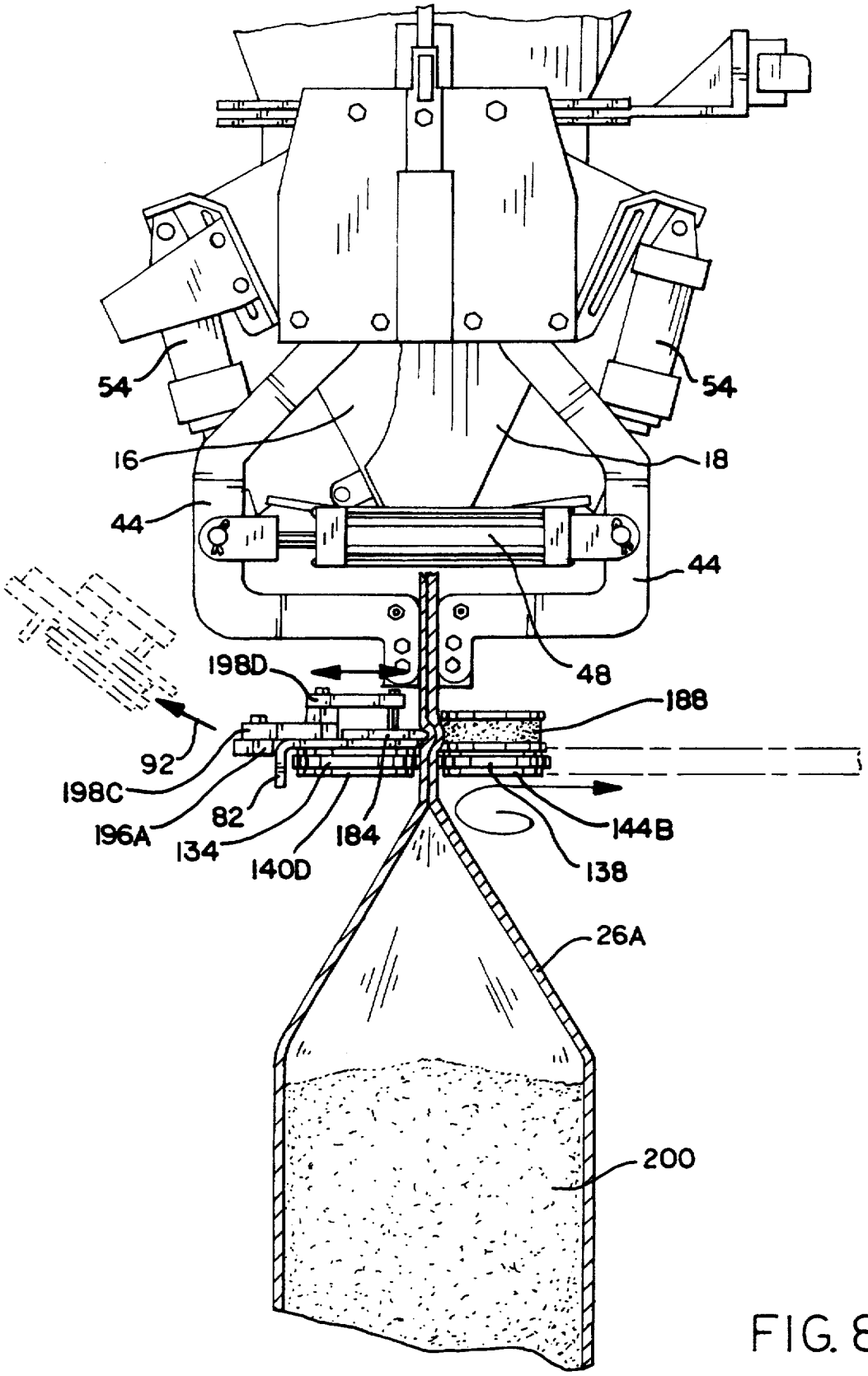
FIG. 8 is a further enlarged side view of the bag forming bar and rotor arms of one version of the high speed bag filling machine of the invention.
Figure 9:
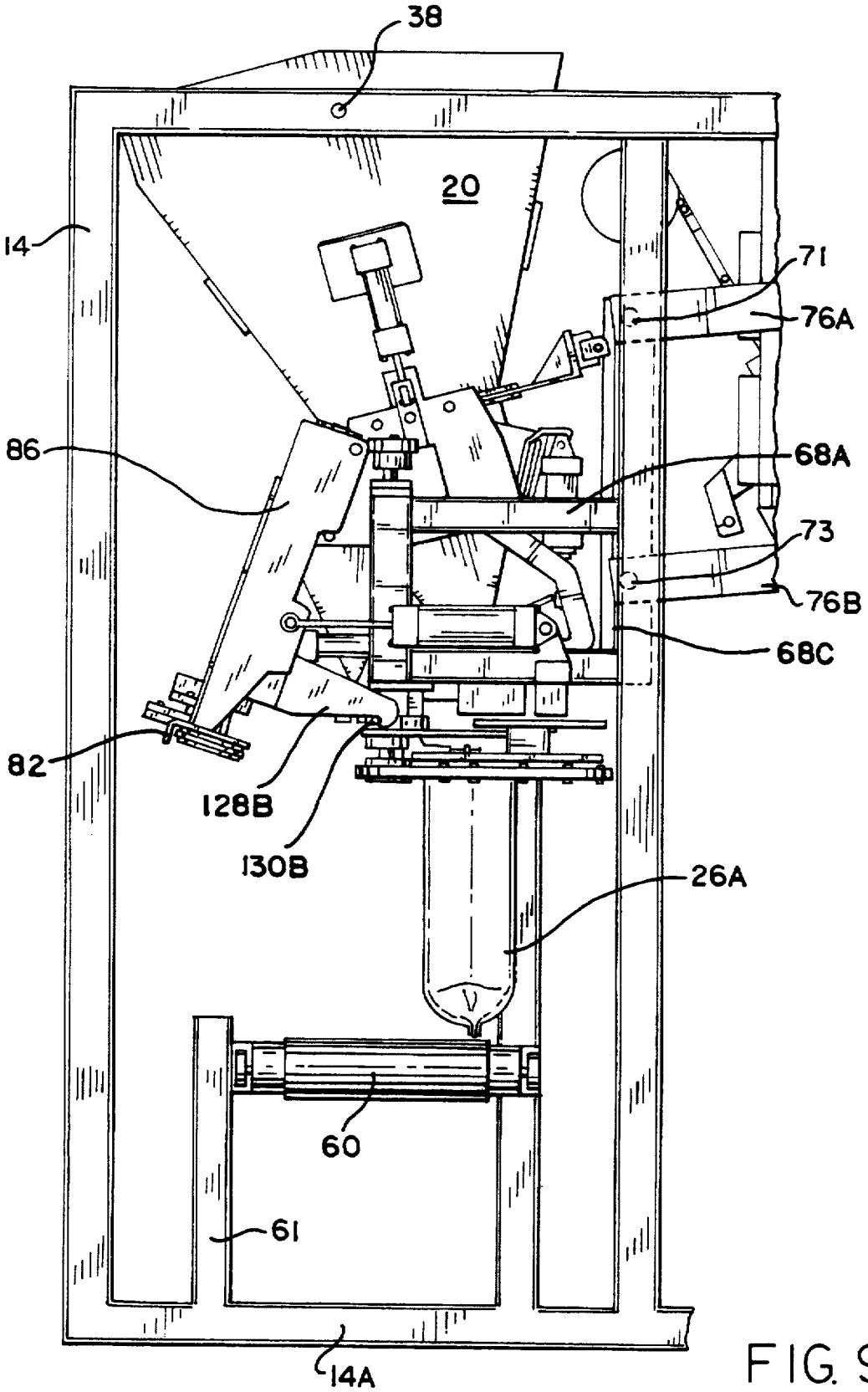
FIG. 9 is a partial right side view of a high speed bag filling machine of the invention, showing a bag attached to a tilted spout and being filled thereby.

With reference to the drawings, and particularly to FIGS. 1, 2 and 3, it may be seen that the high speed bag filling machine 10 of the invention is incorporated into an automated bag filling and closing system 12. The bag filling machine 10 is mounted within and on a frame assembly 14 including a base 14A. The bag filling machine 10 has a fill spout 22 having a spout end 23 for transferring product 24 to an empty bag 26 from a hopper 20. The spout 22 is depicted as being of a clamshell type construction with shell halves 16 and 18 (see FIG. 8), but it is evident that other types of spouts may be used. Included in system 12 is apparatus 36 for supplying and hanging empty bags 26 on the spout 22.

As shown, conveyor belt assembly 60 is supported by legs 61 beneath the spout 22 for transferring filled bags 26A to the sealer infeed 67 of a bag sealing machine 66.

Figure 4:
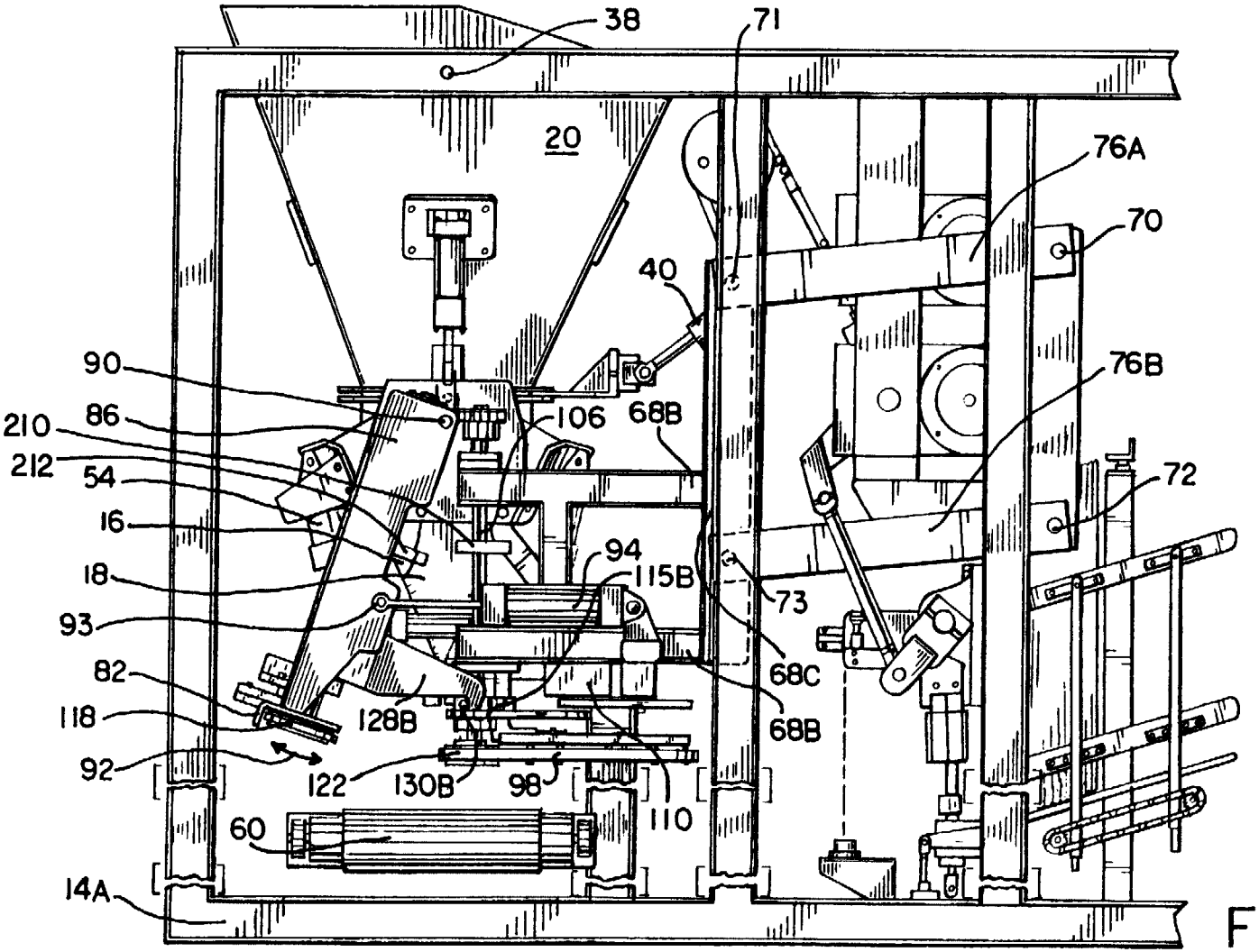
FIG. 4 is a partial right side view of a high speed bag filling machine of the invention, showing movement of a bag forming bar and rotor arms.
Figure 4A:
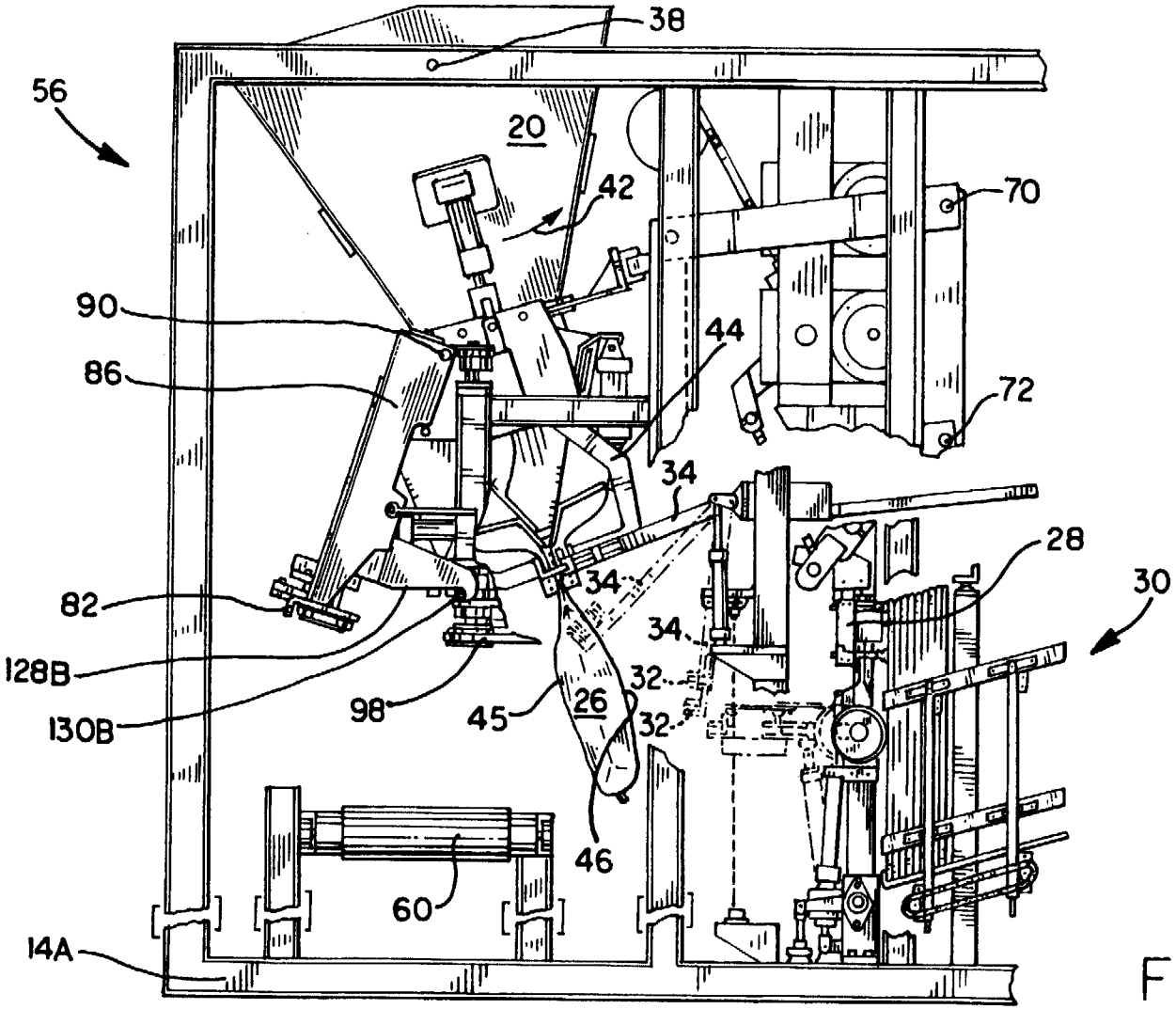
FIG. 4A is a partial right side view of a high speed bag filling machine of the invention, showing the mounting of a bag on the spout of the filling machine.

It should be noted that in each of FIGS. 2, 3 and 4, the vertical distances between the spout 22 and the conveyor belt assembly 60, and between the conveyor belt assembly 60 and the base 14A are shown compressed for purposes of illustration. In FIG. 4A, the vertical distance between the conveyor belt assembly 60 and the base 14A is likewise shown compressed.

Any bag supply and hanging apparatus 36 may be used, provided the bags are sequentially moved to the vicinity of the spout end 23 and hung on the spout 22 at a rate commensurate with the filling machine throughput. As shown in FIGS. 1–3, an exemplary bag supply and hanging apparatus 36 hangs bags on the spout 22, in accordance with the teachings of U.S. Pat. No. 4,612,965 of McGregor and U.S. Pat. No. 4,432,186 of McGregor, the contents of these patents being incorporated by reference. An empty bag 26 is transferred (FIG. 4A) by a bag conveyor 28 from a bag magazine 30 to a position proximate bag pickup and hanging mechanism 34, and is grasped by the bag gripping members 32 of the bag pickup and hanging mechanism. The bag pickup and hanging mechanism 34 pivots upwardly and supplies the empty bag 26 to the fill spout 22 of a rearwardly tilted hopper 20.

The hopper 20 (with attached spout 22 and spout end 23) is pivotally mounted to the frame assembly 14 about axis 38 so that it may be tilted by a motor, e.g. servomotor or a dual acting power cylinder 40 in direction 42 (FIG. 3) towards the bag pickup and hanging mechanism 34 mounted on frame assembly 14. In this first position, i.e. bag pickup position 56 shown in FIG. 4A, the empty bag 26 is positioned over the spout end 23 for filling.

In lieu of tilting the entire hopper 20 with attached spout 22, it is envisioned that the spout 22 may itself be simply tilted relative to the hopper.

In transferring the empty bag 26 to the tilted fill spout 22, the bag is held in place on the fill spout 22 by two pairs of bag holding members 44 which clamp and hold the top gussets on the left edge 47A and right edge 47B of the bag 26, on opposing sides of the fill spout 22. Each pair of bag holding members 44 is pivotably connected to the hopper 20. They are movable to a greater spaced-apart position by the action of dual acting power cylinders 48, for stretching the top 50 of the bag 26 to a relatively taut configuration (FIG. 2).

The central portion of the top 50 of the front face 45 and rear face 46 (FIG. 4A) of each bag 26 is held against the fill spout 22 by one of two clamping assemblies 52 pivotably mounted on the front and rear of the spout 22. Each of the clamping assemblies 52 is pivotable between an open position and a closed position by a dual acting power cylinder 54 mounted on the fill spout 22 or hopper 20.

Thus, it may be seen that an empty bag 26 is mounted onto the fill spout 22 when the latter is in this first position 56, i.e. tilted toward the bag pickup and hanging mechanism 34. The hopper 20 (or fill spout 22) is then reversibly pivoted by cylinder 40 a second position 58 herein denoted as a generally vertical "home" position. In the second or "home" position 58, the spout 22 and bag are positioned above the conveyor belt assembly 60 with a conveyor belt 62 driven by a motor, not shown. The filled bag 26A is released by the clamping assemblies 52 and lowered by the bag holding members 44 to the conveyor belt 62. The filled bag 26A is then moved to a bag sealing apparatus 66 such as a heat sealer, stitcher or adhesive applicator.

It should be noted that the fill spout end 23 may be opened for filling the bag 26 in various timing configurations. Thus, filling may be started and completed while the bag is in the first, i.e. bag pickup position 56. Alternatively, filling may be started and completed while the bag is in the second position 58. A particularly time-saving operation may result when filling is begun in the first position 56, and continued during movement of the bag 26 toward the second position 58. Bag filling may be completed while the bag is in the second position 58. In any case, filling of the bag can be performed in the first position 56 and/or second position 58 and/or during movement from the first position to the second position.

As shown in FIGS. 2 and 3, an important feature of this bag filling machine 10 is a transfer carriage 80 which is mounted on the frame assembly 14 to be vertically movable. The transfer carriage functions to grasp a filled bag 26A on the spout 22 and move it downward onto the conveyor assembly 60. The transfer carriage 80 also assists in discharging the filled bag 26A to the sealing apparatus 66 or to another location.

The transfer carriage 80 includes a rigid frame 68 having side subframes 68A, 68B and rear subframe 68C (see FIGS. 1, 3, 5, and 7). The rigid frame 68 has a general "C" shape and wraps around the sides and rear of the fill spout 22. The rigid frame 68 is pivotably connected to and vertically moved by left parallel lifting members 74A, 74B and right parallel lifting members 76A, 76B, about parallel moving axes 71 and 73. The lifting members are, in turn, pivotably mounted to the frame assembly 14 about fixed axes 70 and 72. As particularly shown in FIG. 3, the lifting members 74A, 74B, 76A and 76B are raised by a power cylinder 78 through a chain 79 attached to a sprocket wheel 81 rotatably mounted at one end of rotatable shaft 77. At each end of the shaft 77, a tierod 83A, 84A has one end pivotably connected to the shaft in an eccentric position 85 and the other end connected to the rear subframe 68C. When the power cylinder 78 retracts the chain 79, the shaft 77 rotates through a partial rotation and the eccentrically mounted tierods 83A, 83B are lifted to raise the transfer carriage 80. The transfer carriage 80 is lowered by gravitational force upon release of fluid from the power cylinder 78. The total vertical movement of the transfer carriage need only be a few inches, sufficient to remove the bag top 50 from the fill spout 22 and drop the filled bag 26A to the conveyor belt 62.

Figure 7:
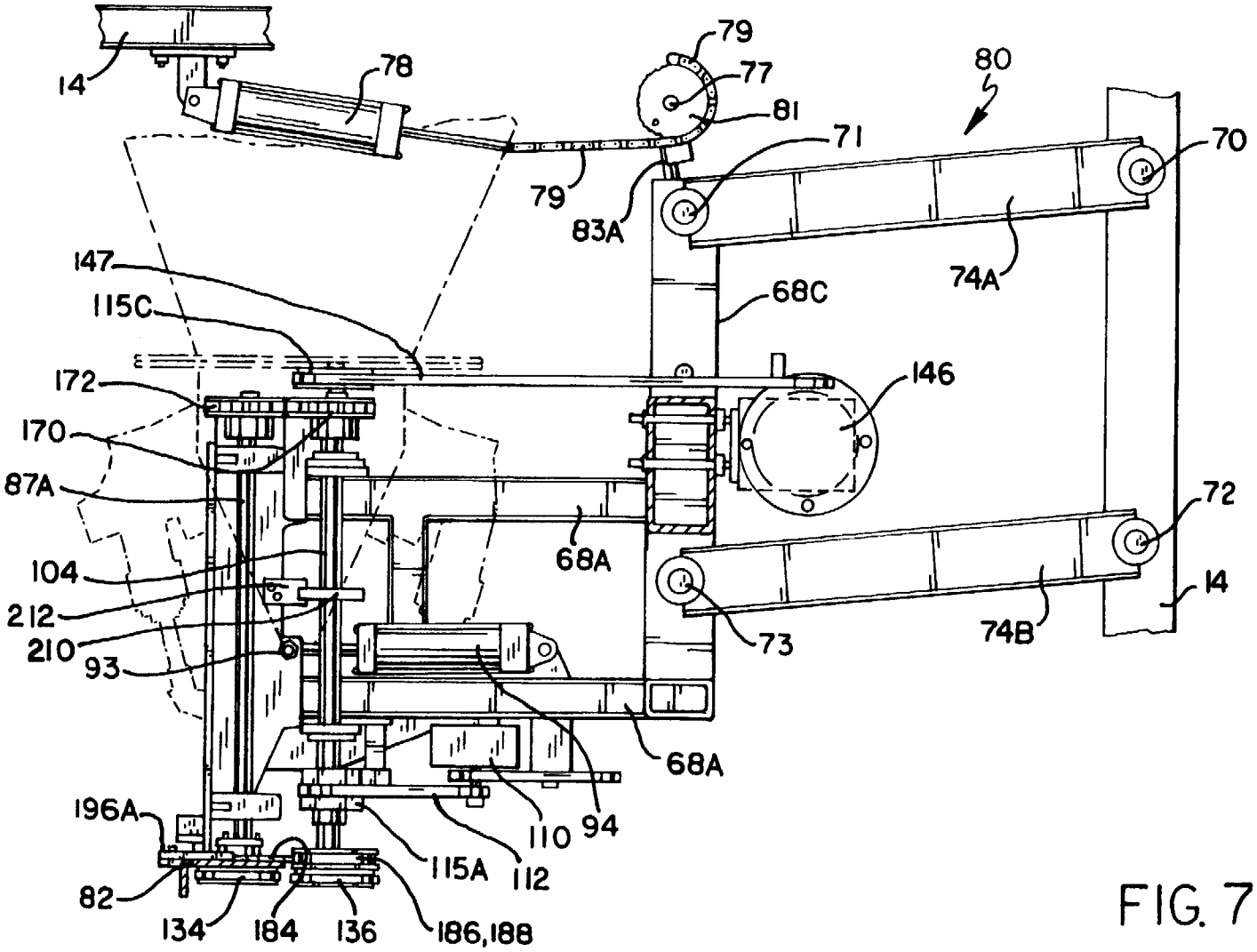
FIG. 7 is an enlarged side view of the transfer carriage of the high speed bag filling machine of the invention, as taken along line 7—7 of FIG. 5.

As shown in FIG. 7, the power cylinder 78 may optionally be mounted on the frame assembly 14 forwardly of the shaft 77. Of course, the transfer carriage may optionally by raised and lowered by other means, including a geared servomotor, not shown.

The transfer carriage 80 includes an elongate forming bar 82 which has attached upright bracket 84 at the left end and upright bracket 86 at the right end. The brackets 84, 86 extend upwardly from the bag forming bar 82 and are pivotably attached to subframes 68A and 68B, respectively to pivot in directions 92 about axis 90 which is parallel to the forming bar 82. Thus, the bag forming bar 82 may be reversibly pivoted outwardly and upwardly by a dual acting power cylinder 94 (FIGS. 3 and 4) in direction 92 to permit apparatus, subsequently described, to be rotated through the prior location of the bag forming bar. The power cylinder shaft 95 is connected to the bracket 84, 86 at pivot connector 93. As shown in the drawings, brackets 84 and 86 enclose rotatable shaft 87A and 87B, respectively. The forming bar 82 engages an upper portion of the filled bag, above the bag contents.

In the bag holding position, two rotor arms 96, 98 are directly behind the bag forming bar 82. The two rotor arms 96, 98 are rotatable about end shafts 104, 106 about generally vertical axes 100, 102, respectively. Each arm 96, 98 is thus driven in a complete circle in a horizontal plane about a vertical axis by a motor 108, 110 acting through an endless belt 112, 114 to drive sheaves 115A, 115B. Motors 108, 110 may be servomotors which turn the rotor arms 96, 98 with a minimum of "slip" when arm movement is halted by servomotor control, latch stops, later described, or by contact with the filled bag 26A itself. The axis 100 passes through the left end of arm 96, and axis 102 passes through the right end of arm 98, so that during a portion of the arm rotation, the spacing between the arms permits passage therebetween of the bag, fill spout 22 with clamping assemblies 52, and bag holding members 44. Typically, the rotor arms are rotated up to about ¾ of a full rotation, and are stopped from rotating further by a latch 128A, 128B which catches an outwardly directed element 130A, 130B mounted on each shaft 104, 106 (see FIGS. 6).

The bag forming bar 82 has a rear surface 118 which substantially spans and contacts an upper portion of the front face 45 of the bag, above the contents 200. Each of the two rotor arms 96, 98 has a front surface 120, 122, respectively, which contacts an upper portion of the rear face 46 of the bag 26A when they are simultaneously rotated to capture the rear face 46 and be biased or locked against it. Thus, the front and rear faces 45, 46 of the filled bag 26A are captured between the bag forming bar 82 and rotor arms 96, 98.

In one version of the transfer carriage 80, surface 118 does not move relative to the bag forming bar 82, and each surface 120 and 122 does not move relative to the respective rotor arm 96, 98 of which it is a part. In operation, a filled bag 64 is "captured" by the rotating rotor arms 96, 98 and the bag forming bar 82, and lowered thereby onto the conveyor belt 62. The bag forming bar 82 is then pivoted outwardly and upwardly to release the bag 64 which is then moved to the e.g. sealer by activation of the conveyor belt 62. The transfer carriage 80 is then raised. The rotor arms 96, 98 are then rotated forwardly beneath the bag forming bar 82 by motors 108, 110 by about 180 to 270 degrees, where further movement is postponed by latches 128A, 128B engaging with the elements 130A, 130B as the forming bar 82 is raised. In this "waiting" position, shown in FIG. 4, the rotor arms 96, 98 do not interfere with movement of the spout 22 or bag 26A, as previously discussed. As shown in the figures, the rotor arms 96, 98 are in the raised position when rotated, passing above the sealer infeed 67.

Another version of the transfer carriage 80 is illustrated in FIGS. 2–11, in which each surface 118, 120 and 122 comprises a moveable endless belt. Thus, surface 118 is an endless elastomeric belt 134 movable on a plurality of pulleys 140A, idler pulleys 140B and end pulleys 140C mounted on the bag forming bar 82.

Figure 6:
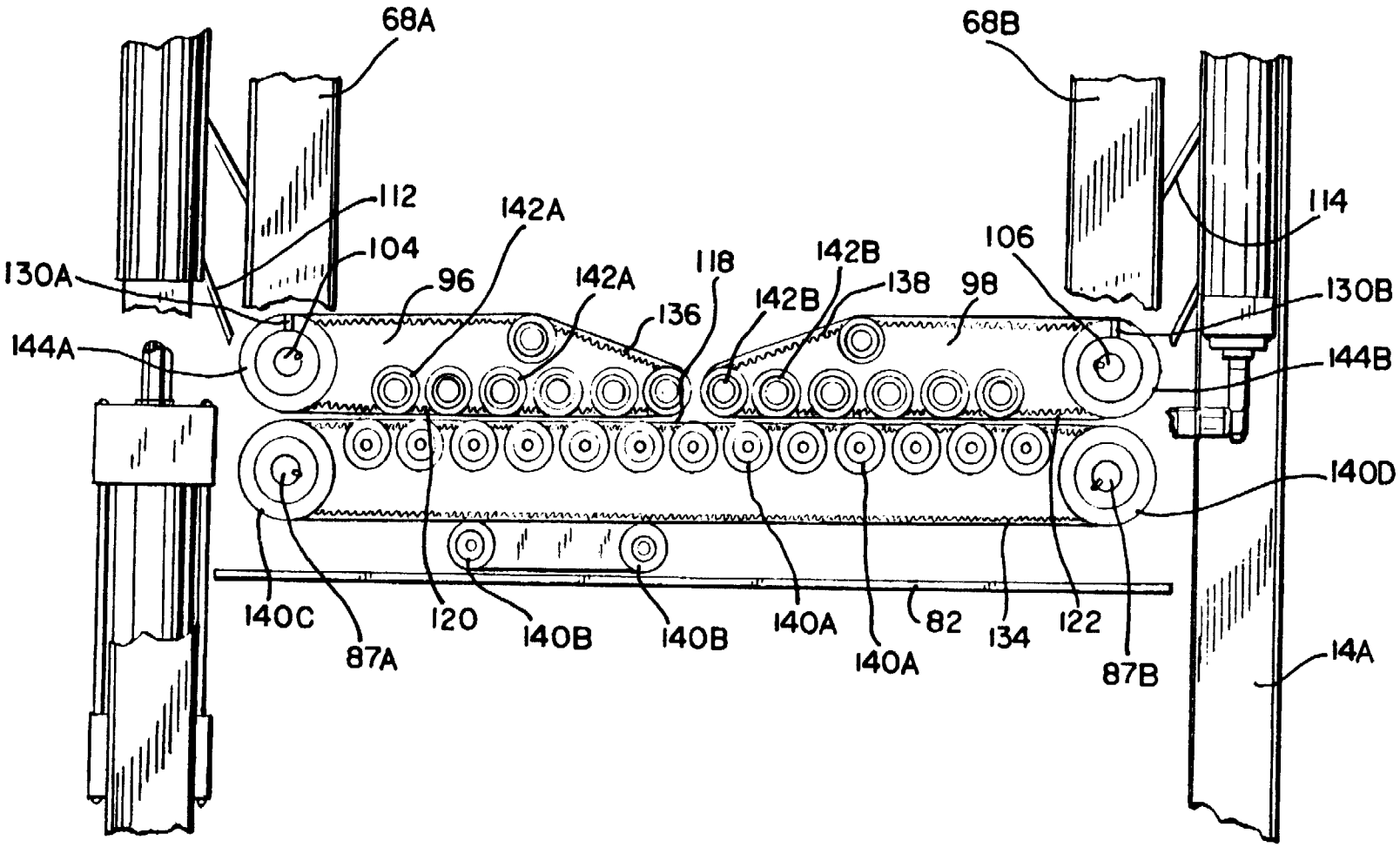
FIG. 6 is an enlarged cross-sectional top view of the bag forming bar and rotor arms of one version of the high speed bag filling machine of the invention, as taken along line 6—6 of FIG. 3.

Surfaces 120 and 122 comprise endless elastomeric belts 136 and 138 movable on a plurality of pulleys 142A, 142B and end pulleys 144A, 144B mounted on the rotor arms 96 and 98, respectively (See FIG. 6).

Figure 5:
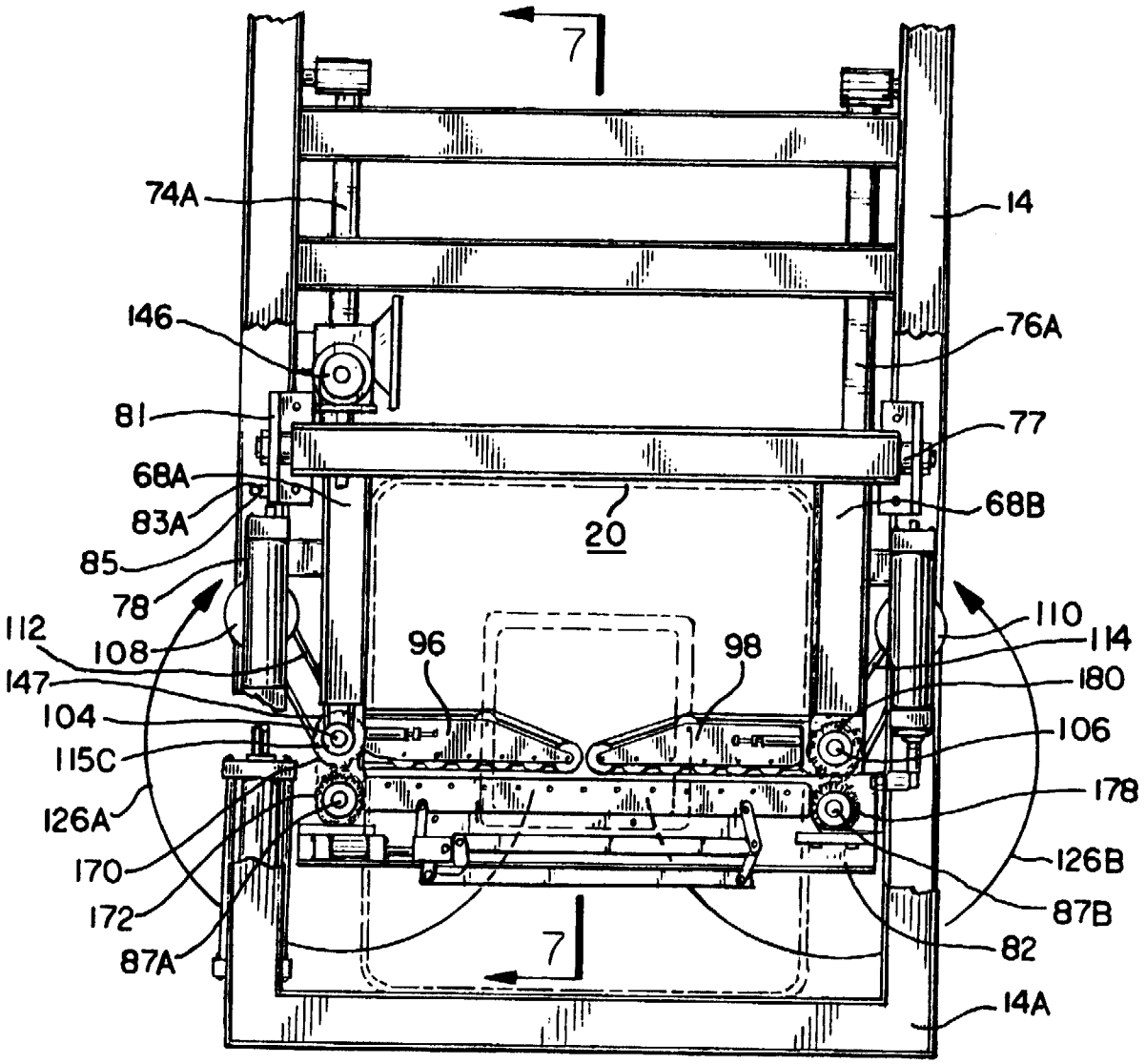
FIG. 5 is a partial top view of the transfer carriage of the high speed bag filling machine of the invention.

The pulleys 140, 142 and 144 for all three belts 134, 136, and 138, respectively, are shown as being interconnected such that they are each driven simultaneously from a single sheave 115C mounted on shaft 104. The sheave 115C is driven by a motor 146 through drive belt 147. Activation of the belts 134, 136 and 138 by motor 146 drives the top of the filled bag 26A to the e.g. sealer infeed 67 in unison with the conveyor belt 62. As shown in FIG. 2, 5 and 6, motor 146 may be an electric motor having an indexing mechanism 148 for sensing the total angular motion of the drive shaft 104. Other conventional servomotors may alternatively be used, or its movement may be time-controlled.

As shown in FIGS. 5 and 6, bag driving belt 134 is shown as passing about end pulleys 140C, alignment pulleys 140A and take-up pulleys 140B. Bag driving belt 136 is shown as passing about end pulley 144A and alignment pulleys 142A. Bag driving belt 138 is shown as passing about end pulley 144B and alignment pulleys 142B. The alignment pulleys 142A, 142B of the two rotor arms 96, 98 may be offset from the alignment pulleys 140A of the bag forming bar 82, to increase the grasp of the bag faces 118, 124 between belt 134 and belts 136 and 138.

Also attached to the vertical rotor arm shaft 104 is a first spur gear 170. A matching second spur gear 172 is mounted on a secondary vertical shaft 87A drivingly connected to end pulley 140C on the bag forming bar 82. The spur gears 170, 172 are positioned with respect to the pivot axis 90 to always be in mesh despite the pivoting action of the bag forming bar 82. Thus, the secondary shaft 140C drives belt 134 on the bag forming bar 82. A third vertical shaft 87B is drivingly connected to end pulley 140D of the bag forming bar 82. End pulley 140D is driven by the belt 134. Attached to the third shaft 87B is a third spur gear 178 which meshes with a fourth spur gear 180 mounted on a fourth vertical shaft 106 connected to end pulley 144B on the rotor arm 98. Spur gears 178 and 180 remain in mesh at all times. Belt 138 is driven by end pulley 144B. Thus, all three belts 134, 136 and 138 are driven by motor 146 for discharging a filled bag 26A from the filling machine 10 to e.g. a sealer 66.

Figure 10:
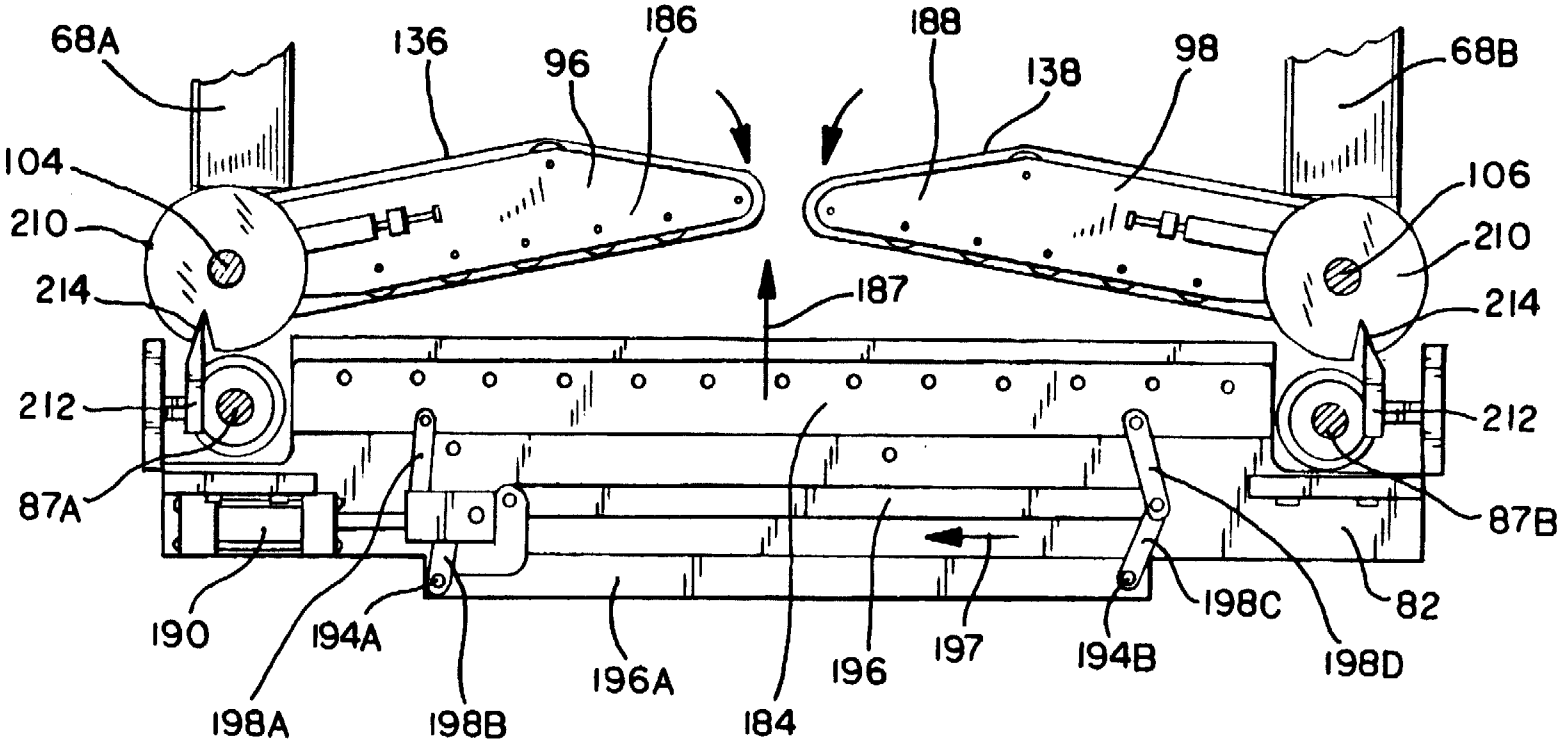
FIG. 10 is a top view of the bag forming bar and rotor arms of the high speed bag filling machine, showing an embodiment of an arm locking device of the invention in an unlocked position.
Figure 11:
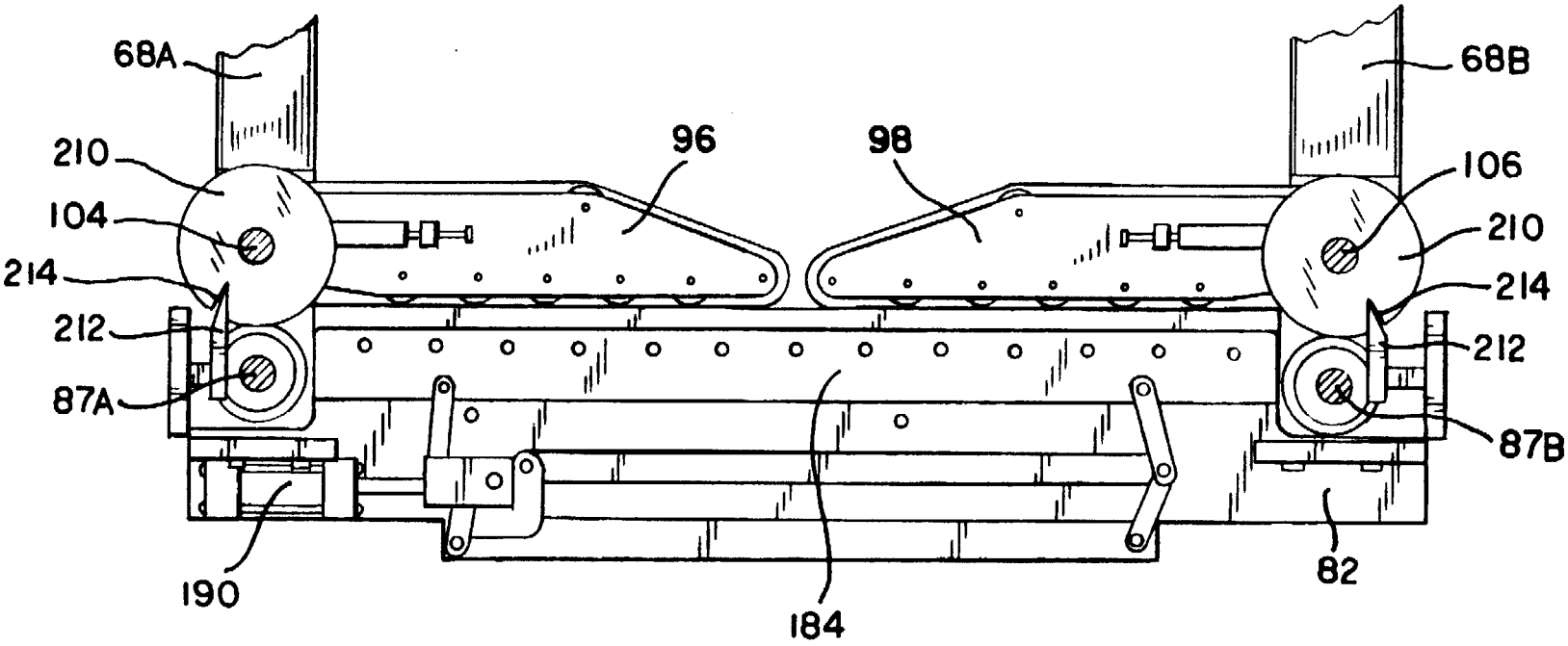
FIG. 11 is a top view of the bag forming bar and rotor arms of the high speed bag filling machine, showing the arm locking device in a locked position.

Best illustrated in FIG. 10 is an additional feature for firmly gripping and holding heavy bags. In addition to the belts 134, 136 and 138, a secondary grip member 184 on the forming bar 82 may be moved toward a matching grip member 186, 188 on each of the rotor arms. A dual acting air cylinder 190 acts through a parallel arm arrangement 192 with fixed axes 194A, 194B. The center member 196 is drawn in direction 197 to straighten cross members 198A, 198B, 198C and 198D, forcing grip member 184 in direction 187 into grip members 186, 188. The force may be easily controlled by controlling the pressure in cylinder 190 and is easily reversed to withdraw the grip members.

Also illustrated in FIGS. is a device for ensuring that the rotor arms 96, 98 engage the rear face of the bag in a position which will firmly and uniformly compress the bag against the forming bar 82. A notched disc 210 is mounted on each of shafts 104, 106 to interact with a pawl 212 adjustably mounted on each of the upright brackets 84, 86. A notch 214 in each disc 210 is configured so that when the forming bar 82 is lowered and the pawl 212 enters the notch, it forces the disc 210 and shaft 104, 106 to rotate the rotor arms to the desired position (see FIG. 11) and hold them rigidly.

The bag filling apparatus incorporates various features as indicated above. Each of the motions is easily controllable from a computer program, enabling rapid adjustments. The system is very compact and relatively simple in design. Very high bagging speeds are easily achieved.

It is anticipated that various changes and modifications may be made in the construction, arrangement, operation and method of construction of the object handling machine disclosed herein without departing from the spirit and scope of the invention as defined in the following claims.

What is claimed is:

1. A high speed bag filling machine, comprising:

a frame assembly;

a bag filling spout for filling a bag with particulate material, said spout attached to said frame assembly and connected to product supply means, said spout being tiltable between a first position and a second position;

means for introducing and attaching a bag to the spout in said first position;

means for supporting said bag on said spout;

means for opening and closing said spout for introducing a quantity of said material into said bag;

means for moving said spout between said first and second positions;

a conveyor assembly located generally beneath the second position of said spout for transporting the filled bag from said filling machine;

a transfer carriage pivotably attached to the frame assembly for reversible vertical movement, said transfer carriage comprising:

a generally horizontal elongate bag forming bar having a rear elongate surface positioned to intercept an upper portion of a first face of the bag when said spout is in said second position, said bag forming bar being pivotable between a bag holding position and a forwardly and upwardly pivoted retracted position, whereby said bag forming bar is pivoted about a horizontal axis upwardly displaced from and generally parallel to the bag forming bar;

a first generally horizontal rotor arm rotatable about a vertical axis at a proximate end thereof, said first rotor arm having a distal end and a first elongate surface positioned between said proximate end and said distal end of said first rotor arm to engage a first upper portion of a second face of the bag;

a second generally horizontal rotor arm rotatable about a vertical axis at a proximate end thereof, said second rotor arm having a distal end and a second elongate surface positioned between said proximate and said distal end of said second rotor arm to engage a second upper portion of the second face of the bag, said distal ends of said first and second rotor arms being proximate each other, whereby a bag may be engaged by and clamped between the first elongate surface and the second and third elongate surfaces;

means for rotating said rotor arms to a position whereby a loaded bag may be passed therebetween; and means for further rotating said rotor arms for engagement of the first and second elongate surfaces with the second face of the bag to clamp said bag against said rear elongate surfaces.

2. The high speed bag filling machine of claim 1, wherein each of said first and second rotor arms is rotated unidirectionally from a bag engaging position to pass under the upwardly pivoted bag forming bar to a holding position outside of the bag path, and then to further rotate to engage the other face of the bag.

3. The high speed bag filling machine of claim 2, further comprising a latch connected to said bag forming bar for catching and holding said first and second rotor arms in said holding position while the bag forming bar is retracted.

4. The high speed bag filling machine of claim 1, wherein said means for rotating said rotor arms comprise airmotors.

5. The high speed bag filling machine of claim 1, whereby said product supply means comprises a hopper connected to said spout and tiltable about a horizontal axis to move said spout between said first and second positions.

6. The high speed bag filling machine of claim 1, wherein said first elongate surface is fixed relative said bag forming bar.

7. The high speed bag filling machine of claim 1, wherein each said second and third elongate surface is fixed relative the rotor arm to which it is attached.

8. The high speed bag filling machine of claim 1, further comprising a lock for holding each said rotor arm against the other face of the bag.

9. The high speed bag filling machine of claim 1, wherein each said first, second and third elongate surface comprise first, second and third endless movable resilient belts.

10. The high speed bag filling machine of claim 9, wherein all of said first, second and third endless movable resilient belts are moved by a single motor acting through two sets of spur gears.

* * * * *